US009397389B2

(12) United States Patent
Mamuro et al.

(10) Patent No.: US 9,397,389 B2
(45) Date of Patent: Jul. 19, 2016

(54) RING ANTENNA

(71) Applicants: NIPPON ANTENA KABUSHIKI KAISHA, Tokyo (JP); SEIKO EPSON CORPORATION, Tokyo (JP)

(72) Inventors: Akio Mamuro, Kuki (JP); Teruhiko Fujisawa, Shiojiri (JP)

(73) Assignees: NIPPON ANTENA KABUSHIKI KAISHA, Tokyo (JP); SEIKO EPSON CORPORATION, Tokyo (JP)

( * ) Notice: Subject to any disclaimer, the term of this patent is extended or adjusted under 35 U.S.C. 154(b) by 127 days.

(21) Appl. No.: 14/348,718

(22) PCT Filed: Dec. 12, 2012

(86) PCT No.: PCT/JP2012/082197

§ 371 (c)(1),
(2) Date: Mar. 31, 2014

(87) PCT Pub. No.: WO2013/132715

PCT Pub. Date: Sep. 12, 2013

(65) Prior Publication Data

US 2014/0240181 A1 Aug. 28, 2014

(30) Foreign Application Priority Data

Mar. 5, 2012 (JP) ..... 2012-048199

(51) Int. Cl.
*H01Q 1/24* (2006.01)
*H01Q 7/00* (2006.01)
(Continued)

(52) U.S. Cl.
CPC ..... *H01Q 1/24* (2013.01); *H01Q 1/273* (2013.01); *H01Q 7/00* (2013.01); *H01Q 9/42* (2013.01)

(58) Field of Classification Search
CPC ..... H01Q 7/00; H01Q 1/273
USPC ..... 343/718, 702
See application file for complete search history.

(56) References Cited

U.S. PATENT DOCUMENTS 5,838,283 A 11/1998 Nakano
6,853,605 B2 * 2/2005 Fujisawa ..... G04B 37/0008 235/487

(Continued)

FOREIGN PATENT DOCUMENTS

JP 2000059241 * 2/2000 ..... H01Q 1/24
JP 2003-163531 A 6/2003

(Continued)

OTHER PUBLICATIONS

Nakano, "Discrete Multiloop, Modified Multiloop, and Plate-Loop Antennas-Multifrequency and Wide-Band VSWR Characteristics," *IEEE Transactions and Propagation*, Mar. 2002, vol. 50, No. 3, pp. 371-378.

(Continued)

*Primary Examiner* — Hoanganh Le
(74) *Attorney, Agent, or Firm* — Oliff PLC

(57) ABSTRACT

A ring antenna has a C-shaped loop element formed on the upper surface of a main body part including a ring-shaped dielectric material having a square cross-sectional shape. A cut part is formed in a portion of this C-shaped loop element, which is formed in the shape of a loop. In addition, an arc-shaped radiation element is formed on the inner circumferential surface of the main body part so as to be concentric with the C-shaped loop element, with a prescribed interval therebetween. The C-shaped loop element is excited by the radiation element. The tip of a feed conductor is connected to a feed part that is connected to one end of the radiation element formed on the lower surface of main body part, and electrical power is fed to the radiation element from the feed conductor.

8 Claims, 19 Drawing Sheets

(51) Int. Cl.
*H01Q 1/27* (2006.01)
*H01Q 9/42* (2006.01)

(56) References Cited

U.S. PATENT DOCUMENTS

| | | | | |
|---|---|---|---|---|
| 8,570,838 | B2 * | 10/2013 | Fujisawa | G04C 10/02 343/718 |
| 2004/0217907 | A1 | 11/2004 | Inoue | |
| 2006/0220957 | A1 | 10/2006 | Tanaka et al. | |
| 2011/0013491 | A1 | 1/2011 | Fujisawa | |
| 2013/0242711 | A1 | 9/2013 | Fujisawa | |
| 2014/0232603 | A1 * | 8/2014 | Fujisawa | G04R 60/12 343/702 |
| 2014/0253394 | A1 | 9/2014 | Nissinen et al. | |

FOREIGN PATENT DOCUMENTS

| | | |
|---|---|---|
| JP | A-2003-163531 | 6/2003 |
| JP | A-2006-287369 | 10/2006 |
| JP | B2-3982918 | 9/2007 |
| JP | A-2008-205531 | 9/2008 |
| JP | B2-4500968 | 7/2010 |
| JP | A-2011-21929 | 2/2011 |
| WO | WO 2007/088799 A1 | 8/2007 |

OTHER PUBLICATIONS

Nakano et al., "C-Figured Loop Antennas," *Electronics Letters*, Apr. 27, 1995, vol. 31, No. 9, pp. 693-694.

International Search Report issued in International Patent Application No. PCT/JP2012/082197 dated Feb. 5, 2013.

* cited by examiner

PRIOR ART

PRIOR ART

PRIOR ART

RING ANTENNA

TECHNICAL FIELD

The present invention relates to a ring antenna capable of receiving a circular polarized wave, which has excellent electric properties even when it is used in a conductive casing.

BACKGROUND OF THE INVENTION

Currently various communication systems are developed and used, and a communication systems of the circular polarized wave mode is known. A circular polarized wave antenna is used for an antenna of terminal equipments in such a communication system. For example, a GPS (Global Positioning System) receiving terminal is known as the terminal equipment, and a patch antenna is used mainly for the GPS receiving antenna equipped with the GPS receiving terminal. By the way, as for the GPS receiving terminal, products of various uses are developed and used, for example, a watch having a built-in GPS receiving terminal is developed and used. But it was difficult to incorporate the patch antenna in the watch, because a clock function part is inside of the watch.

So a configuration of a conventional watch which incorporated the circular polarized wave antenna instead of the patch antenna is shown in FIG. 20 and the exploded perspective view indicating the configuration of the watch is shown in FIG. 21.

In these figures, 101 is a main body of the watch, the main body 101 consists of a main body base 111 made of metal and a band 112. The clock function part and the GPS receiving part are embedded in the main body base 111. Additionally the band 112 is intended to attach the main body 101 to an arm. In addition, on the front of the main body base 111, a display part 113, on which clock information and received information are displayed, is equipped. Furthermore, on the front of the main body base 111, a ring-like step part 111*a* consisting of an annular step is equipped, and a hole 114 of small diameter is formed in the ring-like step part 111*a*.

An antenna part 100 formed in a ring shape is attached to the ring-like step part 111*a* formed around the display part 113. When the antenna part 100 is attached to the ring-like step part 111*a*, the level of the upper surface of the antenna part 100 is substantially corresponding to the level of the upper surface of the display part 113. The antenna part 100 consists of a dielectric substrate 121 formed in a ring shape and a C-shaped loop element 122 formed on the upper surface of the dielectric substrate. The C-shaped loop element 122 has a cut part 123, which cuts the loop in a part, to receive the circular polarized wave. Also, in the part of the C-shaped loop element 122 arranged on the dielectric substrate 121, a feed point 124*a* is formed at the position of a predetermined angle from the cut part 123, and a feed pin 124 is derived from a feed point 124*a*.

The feed pin 124 derived from the antenna part 100 is inserted into a insertion hole 114 when the antenna part 100 is attached to the ring-like step part 111*a*. In this case, the feed pin 124 is coated with insulation coating, or covered with insulation tube so as to avoid directly contacting between the feed pin 124 and the main body base 111 made of metal. When the feed pin 124 is inserted into the insertion hole 114 in this way, the feed pin 124, which is a center conductor, and the main body base 111, which is a ground conductor, form equivalently the coaxial line. Also when the angle between the feed point 124*a* and the cut part 123 is approximately +45 degrees or −135 degrees a left-hand circular polarized wave is radiated from the antenna part 100, when the angle is approximately −45 degrees or +135 degrees a right-hand circular polarized wave is radiated from the antenna part 100.

Frequency characteristics of a voltage standing wave ratio (VSWR) in the frequency band used by the GPS is shown in FIG. 22, and radiation characteristics in a vertical plane is shown in FIG. 23, for the case of locating the conventional antenna part 100 shown in FIG. 20 and FIG. 21 on a quasi casing of the main body 101 of the watch. In this case, when the free-space wavelength at the center in the frequency band for the GPS is defined as λ, for example the circumferential length of the C-shaped loop element 122 is approximately 1.31λ, the height of the dielectric substrate 121 is approximately 0.15λ, the angle between the cut part 123 and the feed point 124*a* is approximately 40 degrees, the length of the cut part 123 is approximately 0.018λ.

Referring to FIG. 22, the best VSWR value of about 1.1909 is shown at 1575.4200 MHz, and the VSWR value to be less than or equal to about 1.85 is shown in the range from 1555.4200 MHz to 1595.4200 MHz.

Also FIG. 23 shows the radiation characteristics at 1575.4200 MHz of the center in the frequency band for the GPS. Referring to FIG. 23, the radiation is the strongest in the zenith direction (0 degree), the peak value is approximately −5.1 dBic. It shows that the gain decreases as an elevation angle becomes small, and in the 90 degrees direction approximately −6 dB of the gain decreases from the gain in the zenith direction, and in the −90 degrees direction approximately −7.5 dB of the gain decreases from the gain in the zenith direction.

PRIOR ART

Patent Document

Patent Document 1: Japanese Patent No. 3982918

SUMMARY OF THE INVENTION

Problems to be Solved by the Invention

The frequency characteristics of the VSWR shown in FIG. 22 and the radiation characteristics shown in FIG. 23 have excellent characteristics in the frequency band for the GPS. However there is the problem that the main body 101 of the watch has a limit in design, because the antenna part 100 shown in FIG. 20 and FIG. 21 is attached to the ring-like step part 111*a* being the outside of the antenna part 100. For this problem, it is thinkable to have the antenna part 100 put in the main body of the watch, but the electric properties of the antenna part 100 became wrong in the case of putting the antenna part 100 in the main body of the watch, because a main body of the watch is generally made of metal. Also there is the problem that it is required to form the special and complex structure as the ring-like step part 111*a* on the main body of the watch for attaching the antenna part 100 to the main body of the watch.

So this invention intends to provide the ring antenna capable of receiving a circular polarized wave, which has excellent electric properties even when it is in the conductive casing, and which is able to be put in a device without forming a special and complex structure.

Means for Solving the Problems

The ring antenna of this invention comprises a main body part which consists of a ring-shaped dielectric substance having a substantially square cross-sectional shape, a C-shaped loop element formed into a loop shape on the upper surface of the main body part and having a cut part in a part of the loop, an arc-shaped radiation element exciting the C-shaped element, which is formed on the inner circumference surface of the main body part so as to be arranged approximately concentrically to the C-shaped loop element with a definite interval, and a feed conductor feeding to the radiation element, which is formed on the lower surface of the main body part and whose tip is connected electrically to the feed part connected to one end of the radiation element, and the ring antenna is able to put in the casing consisting of conductivity materials at least in a part.

Advantages of the Invention

According to this invention, the ring antenna is formed by the ring-shaped main body part that consists of the dielectric substance, where the C-shaped loop element is provided on the upper surface and the arc-shaped radiation element is provided on the inner circumference surface. Then, even when this ring antenna is put in the casing made of metal or with a conductor located in the center area of the exterior casing for housing, the ring antenna has excellent electric properties. Also, electrical power is fed to the radiation element by connecting the feed part, which is connected to one end of the radiation element, to the tip of the feed conductor, and the C-shaped loop element connected electrically is excited by the radiation element.

EMBODIMENTS FOR CARRYING OUT THE INVENTION

Figure 1:
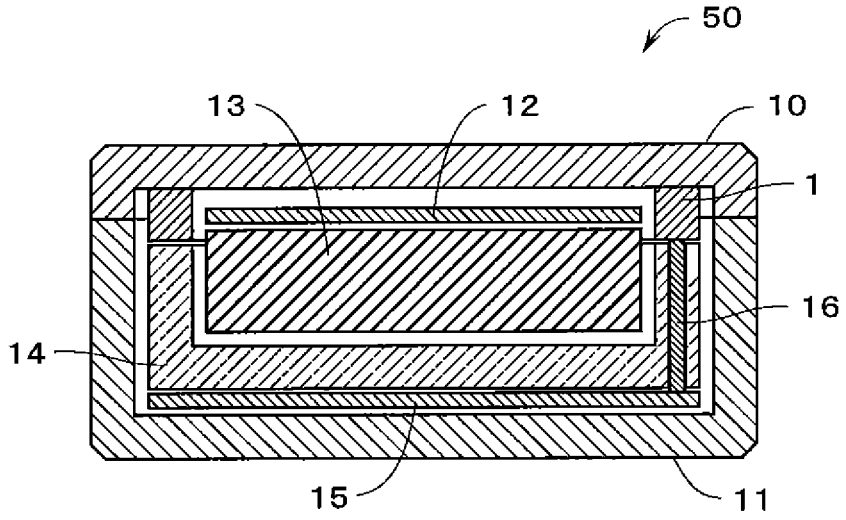
FIG. 1 It is a cross-sectional side view showing the configuration of the GPS apparatus which applied the ring antenna of the embodiment of this invention.
Figure 2:
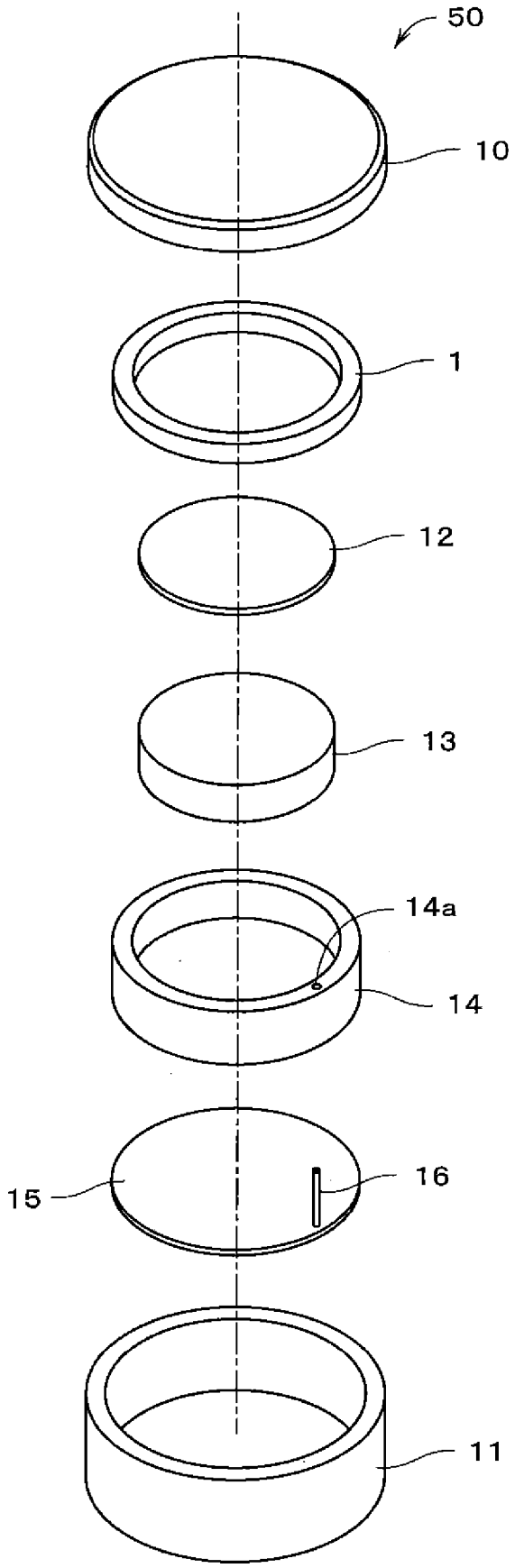
FIG. 2 It is an exploded view showing the configuration of the GPS apparatus which applied the ring antenna of the embodiment of this invention.

The side view indicating the configuration of the GPS apparatus which applied the ring antenna of the embodiment of this invention is shown in FIG. 1, the exploded view is shown in FIG. 2.

The GPS apparatus 50 shown in these figures is equipped with the metal exterior casing 11, which has a cylindrical shape closing the bottom and a U-shaped cross-section. A circuit board 15, which incorporates a GPS receiving part and has a disc shape being slightly smaller than the inside diameter of the exterior casing 11, is located in the bottom of the exterior casing 11. The outer edge part of the circuit board 15 has an antenna terminal, and the lower end of the metal feed conductor 16 is connected electrically to the antenna terminal, the feed conductor 16 is fixed on the circuit board 15 so as to stand upright. An antenna stand 14 made of resin, which has a cylindrical shape closing the bottom and a U-shaped cross-section, and which has the outer diameter that is slightly smaller than the inside diameter of the exterior casing 11 and a U-shaped section, is set on the circuit board 15. At the sidewall of the antenna stand 14, a narrow insertion hole **14*a* penetrating the sidewall is formed, the feed conductor 16 passes through the insertion hole 14*a*, a tip of the feed conductor 16 projects a little from the upper surface of the sidewall. Also, a work part 13 of the GPS apparatus 50 made of resin or metal, which has a disc shape being slightly smaller than the inside diameter of the antenna stand 14, is put in the antenna stand 14. Furthermore, a panel 12 made of resin or metal, which has the almost same diameter as the work part 13, is located on the work part 13**.

Then the ring antenna 1 of this invention, which has a ring shape, is located on the sidewall of the antenna stand 14 so as to contact with the upper surface of the sidewall, the tip of the feed conductor 16 is connected electrically to a feed part which is formed at a lower surface of the ring antenna 1. The ring antenna 1 has the outer diameter that is slightly smaller than the inside diameter of the exterior casing 11, and has the inside diameter that is slightly larger than the outer diameter of the work part 13 and the panel 12. The ring antenna 1 has the ring-shaped dielectric substance, the radiation element is formed on one surface of this dielectric substance, the C-shaped loop element having a loop shape is formed on a surface of the dielectric substance facing to the radiation element, the radiation element and the C-shaped loop element are connected electromagnetically, also the detailed configuration of the ring antenna 1 is mentioned later. The radiation element is supplied with electricity from the feed conductor 16, accordingly the C-shaped loop element, which is a passive element, is excited by the radiation element. The ring antenna 1 is enabled to transmit and receive a circular polarized wave, and the received signal is led to the GPS receiving part, which is incorporated in the circuit board 15, through the feed conductor 16. Also, a cover part 10 made of resin or glass is fixed on the upper surface of the exterior casing 11 to close the opening. The cover part 10 has a cylindrical shape of a U-shaped cross-section, which makes the top closed and the bottom opened and has the same diameter of the exterior casing 11, and the inside which is formed by fixing the cover part 10 on the upper surface of the exterior casing 11 becomes a watertight containing space. As described above, the ring antenna 1, the panel 12, the work part 13, the antenna stand 14, the circuit board 15 and the feed conductor 16 are put in the containing space.

The GPS apparatus 50 shown in FIG. 1 and FIG. 2 is applicable to a watch. In the case of applying the GPS apparatus 50 to the watch, the exterior casing 11 is the metal body of the watch, the work part 13 is a movement of the watch, the panel 12 is a dial plate or a display of time or information, the cover part 10 is made of a clear material such as glass.

Figure 3A:
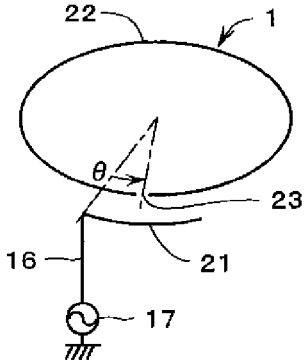
FIG. 3 It is a figure to explain the outline configuration of the ring antenna and the principle of operation of this invention.
Figure 3B:
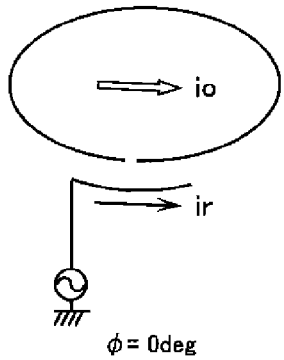
Figure 3C:
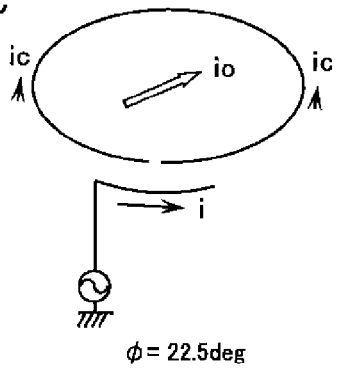
Figure 3D:
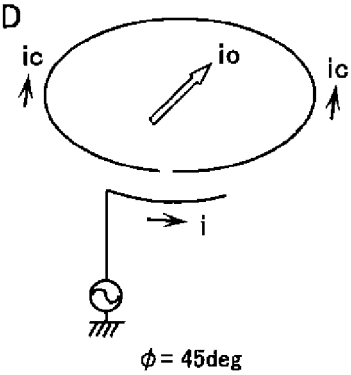
Figure 3E:
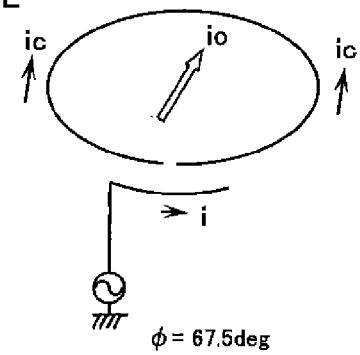
Figure 3F:
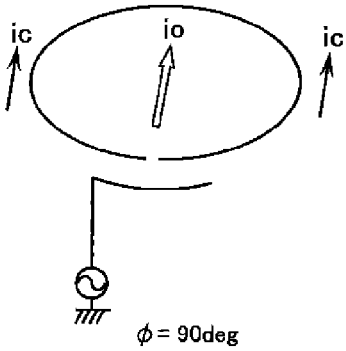
Figure 3G:
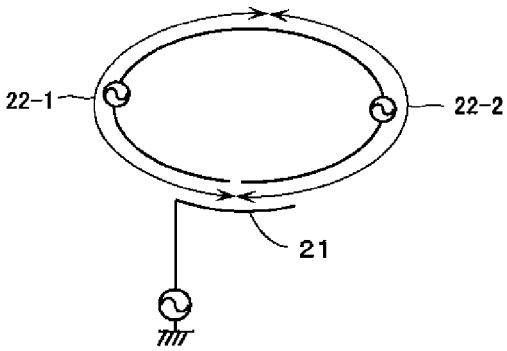
Figure 4A:
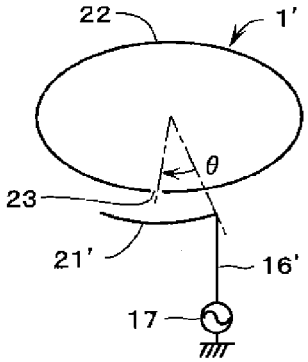
FIG. 4 It is a figure to explain another outline configuration of the ring antenna and another principle of operation of this invention.

The outline configuration of the ring antenna 1 of this invention is shown in FIG. 3A and FIG. 4A here, and the principle of operation of the ring antenna 1 will be explained with referring to FIG. 3B-3G and FIG. 4B-4G.

As shown in FIG. 3A, the ring antenna 1 of this invention has the loop shaped C-shaped loop element 22 which is a passive element and which has a cut part 23 in part, and the arc-shaped radiation element 21 which has about the same diameter of the C-shaped loop element 22 and which is arranged approximately concentrically in parallel to the C-shaped element 22 with a definite interval so as to face the cut part 23 of the C-shaped element 22. Accordingly, the radiation element 21 is connected electromagnetically to the C-shaped loop element 22. The end of this radiation element 21 is connected to the tip of the feed conductor 16 located upright, so the radiation element 21 is supplied with electricity through the feed conductor 16. In the case of FIG. 3A, the radiation element 21 faces the cut part 23 in such a way that the angle θ between the end of this radiation element 21 connected to the tip of the feed conductor 16 and the cut part 23 is approximately +45 degrees. Also if a free-space wavelength of a setup frequency for the ring antenna 1 is defined as λ, for example a circumferential length of the C-shaped loop element 22 is approximately 1λ, an element length of the radiation element 21 is approximately 0.25λ, the interval between the radiation element 21 and the C-shaped loop element 22 is approximately 0.01λ.

In the case of the ring antenna 1 shown in FIG. 3A, when the electrical power is fed by a source 17 located at another end of the feed conductor 16, on the occasion of defining a phase of the source 17 as ϕ, a current ir flowing through the radiation element 21, a current ic flowing through the C-shaped loop element 22, and a composite current vector io to synthesize the current ir and the current ic are shown in FIG. 3B-3F. FIG. 3B shows the case when the phase ϕ of the source 17 is 0 degree, although the current ir flowing through the radiation element 21 is maximized, the current ic flowing through the C-shaped loop element 22 is minimized, and the composite current vector io is turned toward almost the right direction of the space of paper. When the phase ϕ of the source 17 rises to 22.5 degrees, as shown in FIG. 3C, although the current ir flowing through the radiation element 21 decreases a little, a small current ic gets to flow through the C-shaped loop element 22, and the composite current vector io is turned a little to the left direction of the space of paper. Also, the peak of the current ic is located at the position of ±90 degrees from the cut part 23 of C-shaped loop element 22 as shown in the figure. Then, when the phase ϕ of the source 17 rises to 45 degrees, as shown in FIG. 3D, although the current ir flowing through the radiation element 21 decreases moreover, the current ic flowing through the C-shaped loop element 22 increases, and the composite current vector io is turned additionally to the left direction of the space of paper. Furthermore, when the phase ϕ of the source 17 rises to 67.5 degrees, as shown in FIG. 3E, although the current ir flowing through the radiation element 21 decreases even more additionally, the current ic flowing through the C-shaped loop element 22 increases moreover, and the composite current vector io is turned even more additionally to the left direction of the space of paper. Then, when the phase ϕ of the source 17 rises to 90 degrees, as shown in FIG. 3F, although the current ir flowing through the radiation element 21 is minimized, the current ic flowing through the C-shaped loop element 22 is maximized, and the composite current vector io is turned toward the 90 degrees left direction from the one when the phase ϕ of the source 17 is 0 degree. Then because a composite current vector contribute to radiate, a right-hand circular polarized wave making a right hand turn to the forward direction is radiated from the ring antenna 1.

As mentioned above, in the ring antenna 1 shown in FIG. 3A, a standing wave is generated on the C-shaped loop element 22 excited by the radiation element 21, and the peak of the current ic is located at the position of ±90 degrees from the cut part 23 of C-shaped loop element 22. When the ring antenna 1 shown in FIG. 3A is indicated equivalently, as shown in FIG. 3G, the C-shaped loop element 22 runs equivalently between the first dipole element 22-1 having a feed part at the position of approximately −90 degrees from the cut part 23 and the second dipole element 22-2 having a feed part at the position of approximately +90 degrees from the cut part 23. In other words, a radiation from the first dipole element 22-1 and the second dipole element 22-2, and a radiation from the radiation element 21 arranged orthogonally are synthesized, and the ring antenna 1 for the case of considering the angle θ as approximately +45 degrees radiates a right-hand circular polarized wave.

Also, in the case of the ring antenna 1' shown in FIG. 4A, the radiation element 21' faces the cut part 23 in such a way that the angle θ between the end of the radiation element 21' connected to the tip of the feed conductor 16' and the cut part 23 is approximately −45 degrees. The other configurations are similar to the ring antenna 1 shown in FIG. 3A.

Figure 4B:
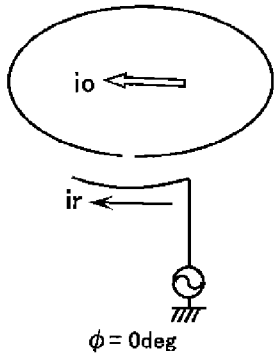
Figure 4C:
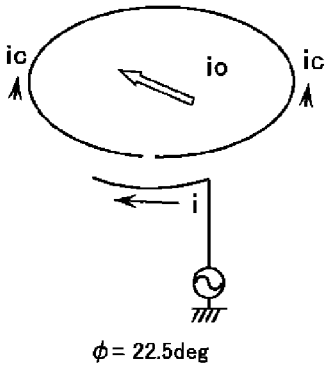
Figure 4D:
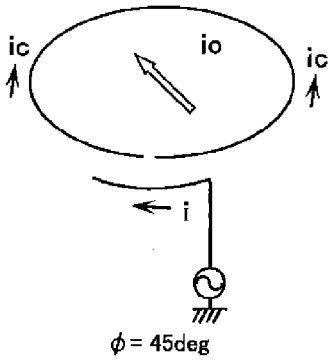
Figure 4E:
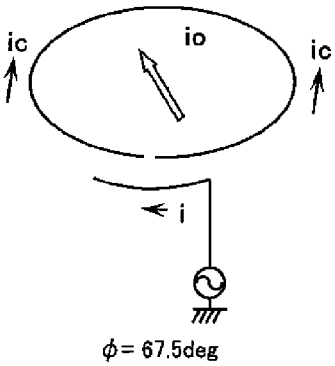
Figure 4F:
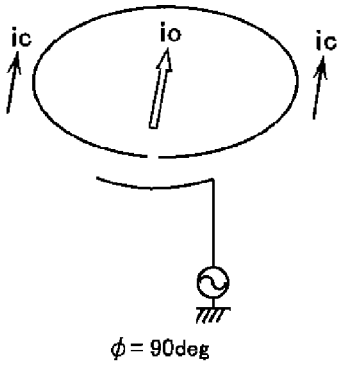

In the case of the ring antenna 1' shown in FIG. 4A, when the electrical power is fed by a source 17 located at another end of the feed conductor 16', a current ir flowing through the radiation element 21', a current ic flowing through the C-shaped loop element 22, and a composite current vector io to synthesize the current ir and the current ic on the occasion of defining a phase of the source 17 as ϕ are shown in FIG. 4B-4F. FIG. 4B shows the case when the phase ϕ of the source 17 is 0 degree, although the current ir flowing through the radiation element 21' is maximized, the current ic flowing through the C-shaped loop element 22 is minimized, and the composite current vector io is turned toward almost the left direction of the space of paper. When the phase ϕ of the source 17 rises to 22.5 degrees, as shown in FIG. 4C, although the current ir flowing through the radiation element 21' decreases a little, a small current ic gets to flow through the C-shaped loop element 22, and the composite current vector io is turned a little to the right direction of the space of paper. Also, the peak of the current ic is located at the position of ±90 degrees from the cut part 23 of C-shaped loop element 22 as shown in the figure. Then, when the phase ϕ of the source 17 rises to 45 degrees, as shown in FIG. 4D, although the current ir flowing through the radiation element 21' decreases moreover, the current ic flowing through the C-shaped loop element 22 increases, and the composite current vector io is turned additionally to the right direction of the space of paper. Furthermore, when the phase ϕ of the source 17 rises to 67.5 degrees, as shown in FIG. 4E, although the current ir flowing through the radiation element 21' decreases even more additionally, the current ic flowing through the C-shaped loop element 22 increases moreover, and the composite current vector io is turned even more additionally to the right direction of the space of paper. Then, when the phase ϕ of the source 17 rises to 90 degrees, as shown in FIG. 4F, although the current ir flowing through the radiation element 21' is minimized, the current ic flowing through the C-shaped loop element 22 is maximized, and the composite current vector io is turned toward the 90 degrees right direction from the one when the phase ϕ of the source 17 is 0 degree. Then because a composite current vector contribute to radiate, a left-hand circular polarized wave making a left hand turn to the forward direction is radiated from the ring antenna 1'.

Figure 4G:
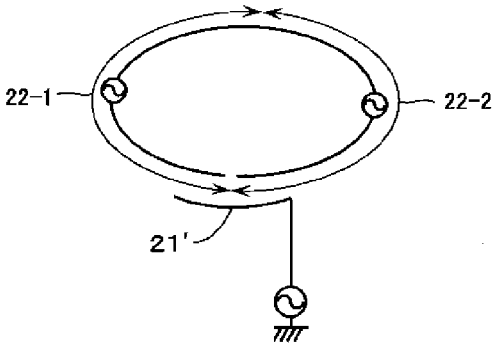

As mentioned above, in the ring antenna 1' shown in FIG. 4A, a standing wave is generated on the C-shaped loop element 22 excited by the radiation element 21', and the peak of the current ic is located at the position of ±90 degrees from the cut part 23 of C-shaped loop element 22. When the ring antenna 1' shown in FIG. 4A is indicated equivalently, as shown in FIG. 4G, the C-shaped loop element 22 runs equivalently between the first dipole element 22-1 having a feed part at the position of approximately −90 degrees from the cut part 23 and the second dipole element 22-2 having a feed part at the position of approximately +90 degrees from the cut part 23. In other words, a radiation from the first dipole element 22-1 and the second dipole element 22-2, and a radiation from the radiation element 21' arranged orthogonally are synthesized, and the ring antenna 1' for the case of considering the angle θ as approximately −45 degrees radiates a left-hand circular polarized wave.

Figure 5A:
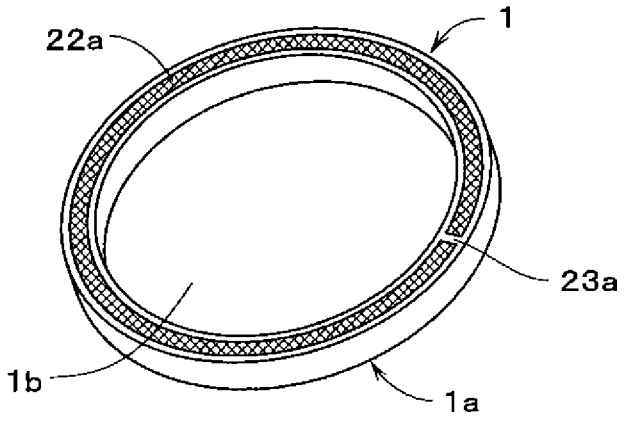
FIG. 5 It is a perspective view, a front view, and a top view showing the configuration of the first embodiment in the ring antenna of this invention.
Figure 5B:
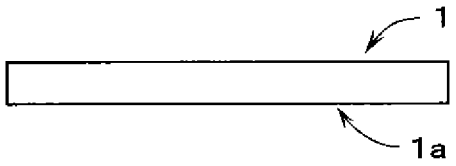
Figure 5C:
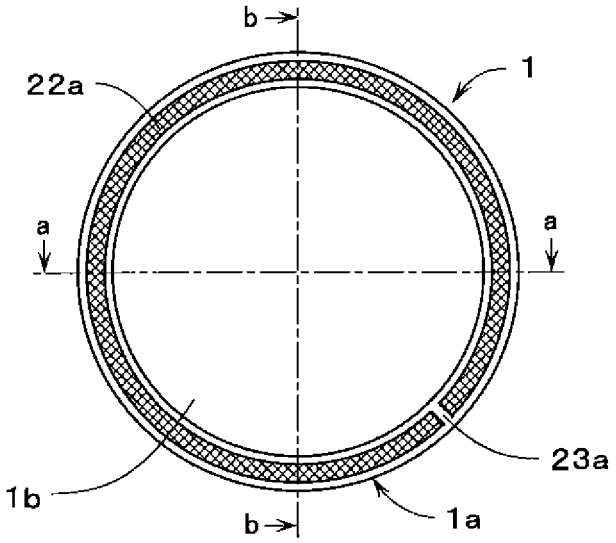
Figure 6A:
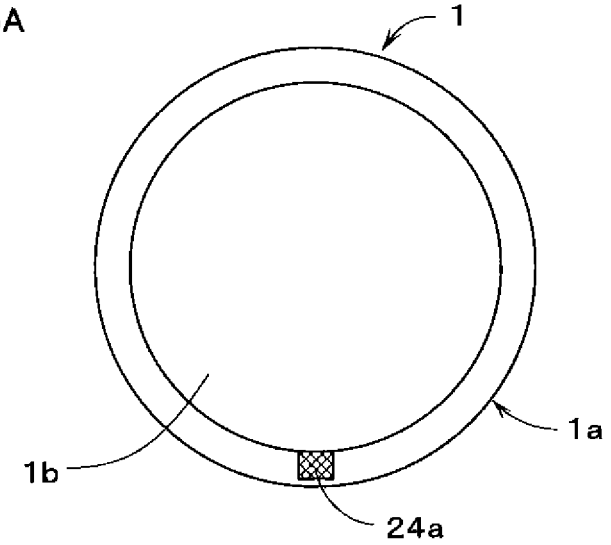
FIG. 6 It is a bottom view showing the configuration of the first embodiment in the ring antenna of this invention, the cross-sectional view along the line a-a, the cross-sectional view along the line b-b.
Figure 6B:
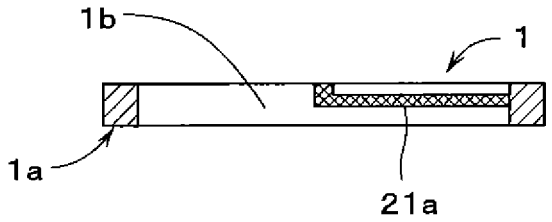
Figure 6C:
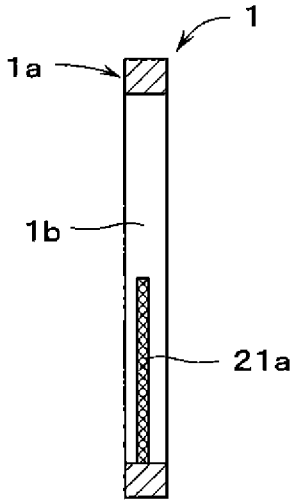

Then, a perspective view indicating the configuration of the first embodiment of the ring antenna of this invention is shown in FIG. 5A, the front view is shown in FIG. 5B, the top view is shown in FIG. 5C, the bottom view is shown in FIG. 6A, the cross-sectional view along the line a-a is shown in FIG. 6B, the cross-sectional view along the line b-b is shown in FIG. 6C.

The ring antenna 1 of the first embodiment of this invention shown in these figures has a main body part 1*a* consisting of a ring-shaped dielectric substance where a large through-hole 1*b* is formed, and whose cross sectional shape is substantially square, and a C-shaped loop element 22*a* having a loop shape, which has a prescribed width, is formed on the approximately center of the upper surface of the ring shaped main body part 1*a*. The cut part 23*a* having a prescribed length is arranged at a predetermined part of the C-shaped loop element 22*a*. Also, the arc shaped radiation element 21*a* having a prescribed length is formed at the approximately center of the inner circumference surface of the ring shaped through-hole 1*b* of the main body part 1*a* so as to face the cut part 23*a* of the C-shaped loop element 22*a*. Additionally, an end of the radiation element 21*a* is bent downward to form a feed part 24*a*, and a pattern of this feed part 24*a* extends to a lower surface of the main body part 1*a*. The feed part 24*a*, which is arranged at the lower surface of the main body part 1*a*, is formed into a square shaped pattern having a predetermined area to contact electrically with the tip of the feed conductor 16. In the first embodiment of the ring antenna 1, because the radiation element 21*a* is arranged so as to face the C-shaped loop element 22*a* with a definite interval, both are connected electromagnetically. Also, the C-shaped loop element 22*a*, the radiation element 21*a* and the feed part 24*a* are formed on the main body part 1*a* consisting of the dielectric substance by depositing metal material or putting a metal thin plate.

Figure 7A:
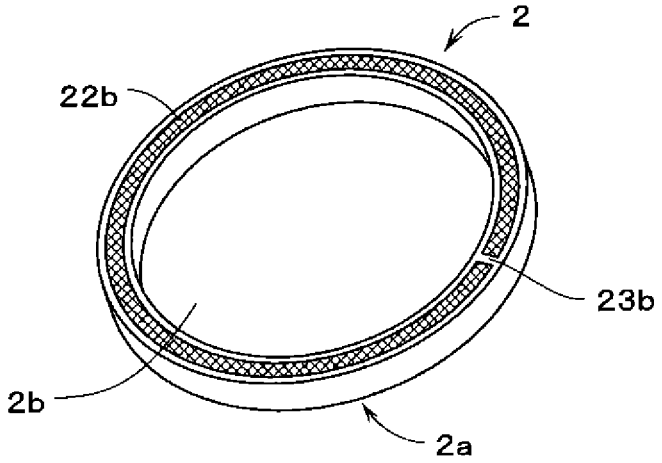
FIG. 7 It is a perspective view and a front view showing the configuration of the second embodiment in the ring antenna of this invention.
Figure 7B:
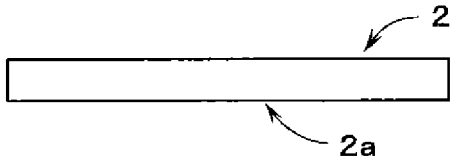
Figure 8A:
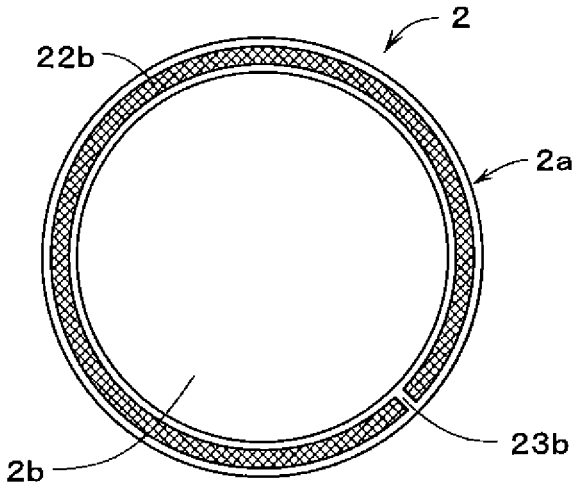
FIG. 8 It is a top view and a bottom view showing the configuration of the second embodiment in the ring antenna of this invention.
Figure 8B:
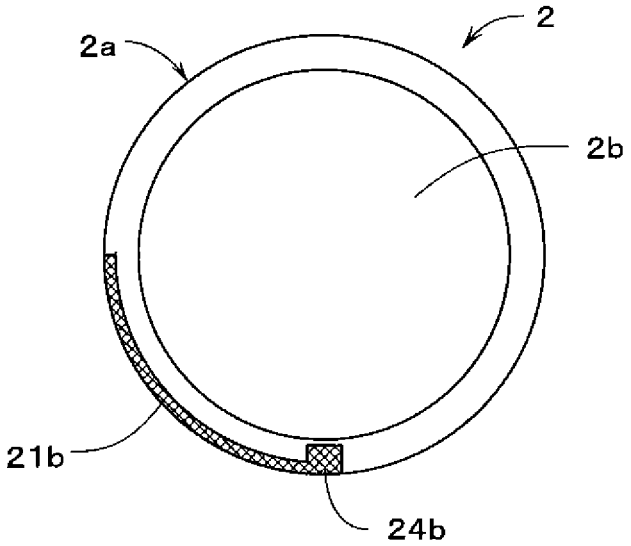

Then, a perspective view indicating the configuration of the second embodiment of the ring antenna of this invention is shown in FIG. 7A, the front view is shown in FIG. 7B, the top view is shown in FIG. 8A, the bottom view is shown in FIG. 8B.

The ring antenna 2 of the second embodiment of this invention shown in these figures has a main body part 2*a* consisting of a ring-shaped dielectric substance where a large through-hole 2*b* is formed, and whose cross sectional shape is substantially square, and a C-shaped loop element 22*b* having a loop shape, which has a prescribed width, is formed on the approximately center of the upper surface of the ring shaped main body part 2*a*. The cut part 23*b* having a prescribed length is arranged at a predetermined part of the C-shaped loop element 22*b*. Also, the arc shaped radiation element 21*b* having a prescribed length is formed on the ring shaped lower surface of the main body part 2*a* along the circumference surface so as to face the cut part 23*b* of the C-shaped loop element 22*b*. A square shaped feed part 24*b* having a predetermined area to contact electrically with the tip of the feed conductor 16 is arranged at an end of the radiation element 21*b*. In the second embodiment of the ring antenna 2, because the radiation element 21*b* is arranged so as to face the C-shaped loop element 22*b* with a definite interval, both are connected electromagnetically. Also, the C-shaped loop element 22*b*, the radiation element 21*b* and the feed part 24*b* are formed on the main body part 2*a* consisting of the dielectric substance by depositing metal material or putting a metal thin plate.

Figure 9A:
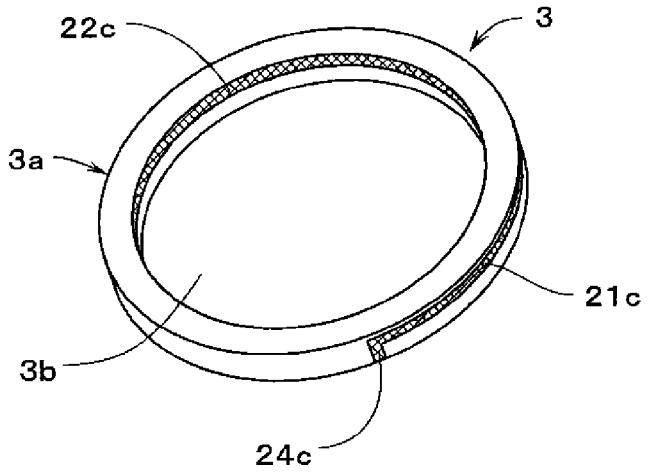
FIG. 9 It is a perspective view, a top view, and a side view showing the configuration of the third embodiment in the ring antenna of this invention.
Figure 9B:
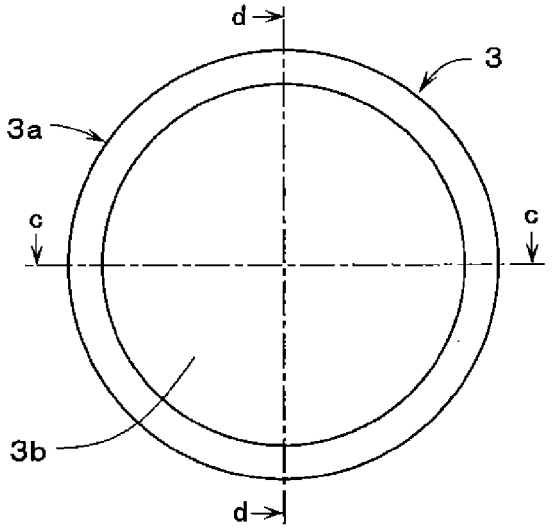
Figure 9C:
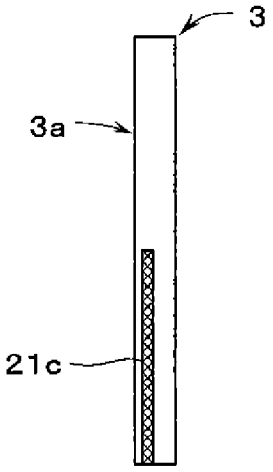
Figure 10A:
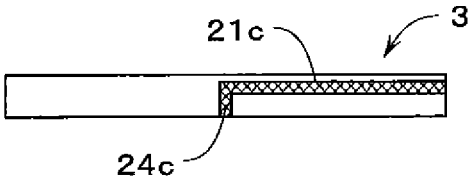
FIG. 10 It is a front view and a bottom view showing the configuration of the third embodiment in the ring antenna of this invention, the cross-sectional view along the line c-c, the cross-sectional view along the line d-d.
Figure 10B:
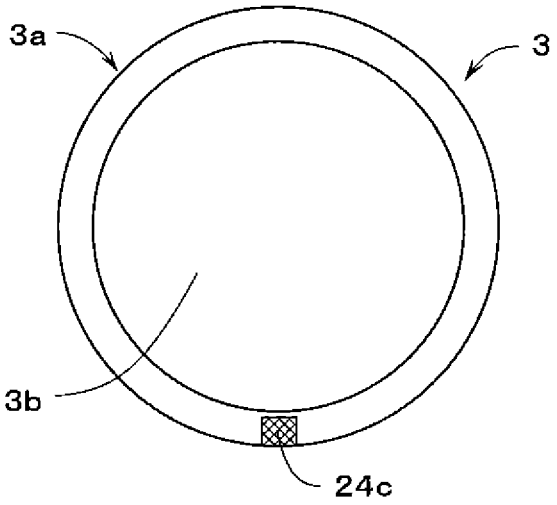
Figure 10C:
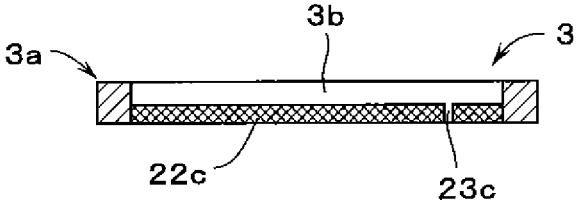
Figure 10D:
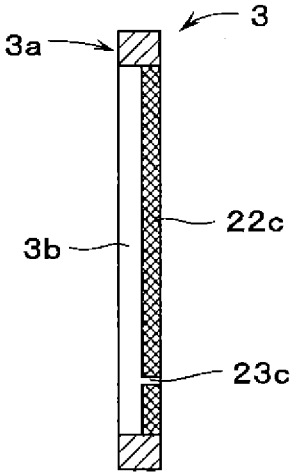

Then, a perspective view indicating the configuration of the third embodiment of the ring antenna of this invention is shown in FIG. 9A, the top view is shown in FIG. 9B, the side view is shown in FIG. 9C, the front view is shown in FIG. 10A, the bottom view is shown in FIG. 10B, the cross-sectional view along the line c-c is shown in FIG. 10C, the cross-sectional view along the line d-d is shown in FIG. 10D.

The ring antenna 3 of the third embodiment of this invention shown in these figures has a main body part 3*a* consisting of a ring-shaped dielectric substance where a large through-hole 3*b* is formed, and whose cross sectional shape is substantially square, and a C-shaped loop element 22*c* having a loop shape is arranged on the approximately upper half of the inner circumference surface of the large through-hole 3*b* formed in the main body part 3*a*. The cut part 23*c* having a prescribed length is arranged at a predetermined part of the C-shaped loop element 22*c*. Also, the arc shaped radiation element 21*c* having a prescribed length is formed on the upper half of the circumference surface of the main body part 3*a* so as to face the cut part 23*c* of the C-shaped loop element 22*c*. Additionally, an end of the radiation element 21*c* is bent downward to form a feed part 24*c*, and a pattern of this feed part 24*c* extends to a lower surface of the main body part 3*a*. The feed part 24*c*, which is arranged at the lower surface of the main body part 3*a*, is formed into a square shaped pattern having a predetermined area to contact electrically with the tip of the feed conductor 16. In the third embodiment of the ring antenna 3, because the radiation element 21*c* is arranged so as to face the C-shaped loop element 22*c* with a definite interval, both are connected electromagnetically. Also, the C-shaped loop element 22*c*, the radiation element 21*c* and the feed part 24*c* are formed on the main body part 3*a* consisting of the dielectric substance by depositing metal material or putting a metal thin plate.

The ring antenna 1-3 of the first embodiment to the third embodiment described above are available for the GPS antenna. Explaining the size of the ring antenna 1-3 of this case, if the free-space wavelength of the center frequency in the frequency band for the GPS is defined as λ, as for the circumferential length of the C-shaped loop element 22*a*-22*c*, the optimum value is 1λ, and the range is approximately 0.8λ-1.3λ. Also, as for the length of the radiation element 21*a*-21*c*, the optimum value is 0.25λ, and the range is approximately 0.05λ-0.5λ. Additionally, as for the length of the cut part 23*a*-23*c*, the optimum value is 0.03λ, and the range is approximately 0.001λ-0.25λ. Furthermore, as for the interval between the C-shaped loop element 22*a*-22*c* and the radiation element 21*a*-21*c*, the optimum value is 0.01λ, and the range is approximately 0.001λ-0.05λ. Then, when the dielectric constant of the main body part 1*a*-3*a* is a significant value, and the wavelength in the main body part 1*a*-3*a* is shortened to λ', the size for the case of replacing the wavelength λ described above with the wavelength λ' is applied.

By the way, when the angle θ between the feed part 24*a*-24*c* (one end of the radiation element 21*a*-21*c*) and the cut part 23*a*-23*c* of the C-shaped element 22*a*-22*c* is approximately +45 degrees or +225 degrees, a right-hand circular polarized wave is radiated from the antenna 1-3, and when the angle θ is approximately −45 degrees or −225 degrees, a left-hand circular polarized wave is radiated from the antenna 1-3. In this instance, as for the angle θ, the optimum value is ±45 or ±225 degrees, the range of the angle for the right-hand circular polarized wave is approximately +0-+90 degrees or approximately +180-+270 degrees, the range of the angle for the left-hand circular polarized wave is approximately −0--90 degrees or approximately −180--270 degrees.

The GPS apparatus 50 shown in FIG. 1 or 2 is able to have one of the ring antenna 1-3 of the first embodiment to third embodiment built-in. When it is built-in, the bottom surface of the exterior casing 11 works as a ground plane.

Figure 11:
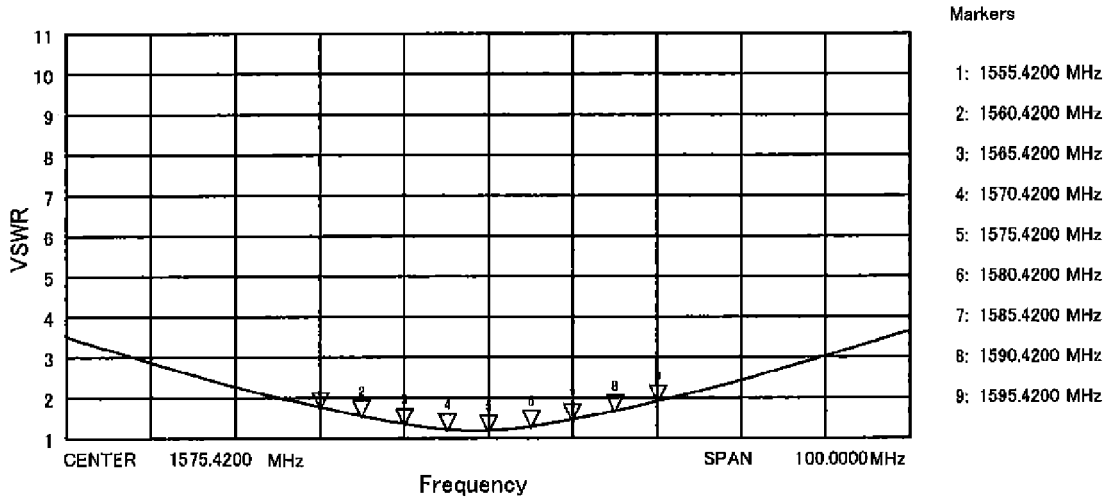
FIG. 11 It is a chart indicating the frequency characteristics of the VSWR for the ring antenna of this invention.
Figure 12:
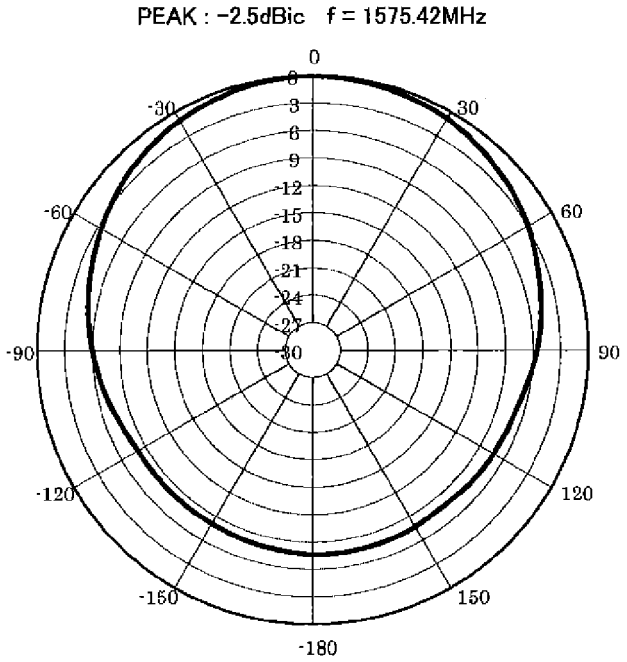
FIG. 12 It is a chart indicating the radiation characteristics for the ring antenna of this invention.

Here, the frequency characteristics of the VSWR for the case that the ring antenna 1 of the first embodiment is put in the GPS apparatus 50 is shown in FIG. 11, and the radiation characteristics in a vertical plane for the case of locating the GPS apparatus horizontally is shown in FIG. 12. In this case, the frequency band in use is the GPS frequency band, the size of the ring antenna 1 is the optimum value mentioned above. Also, a minimum interval between the radiation element 21*a* or the C-shaped loop element incorporated in the ring antenna 1 and the exterior casing 11, the panel 12, or the work part 13 is approximately 0.001λ.

Figure 22:
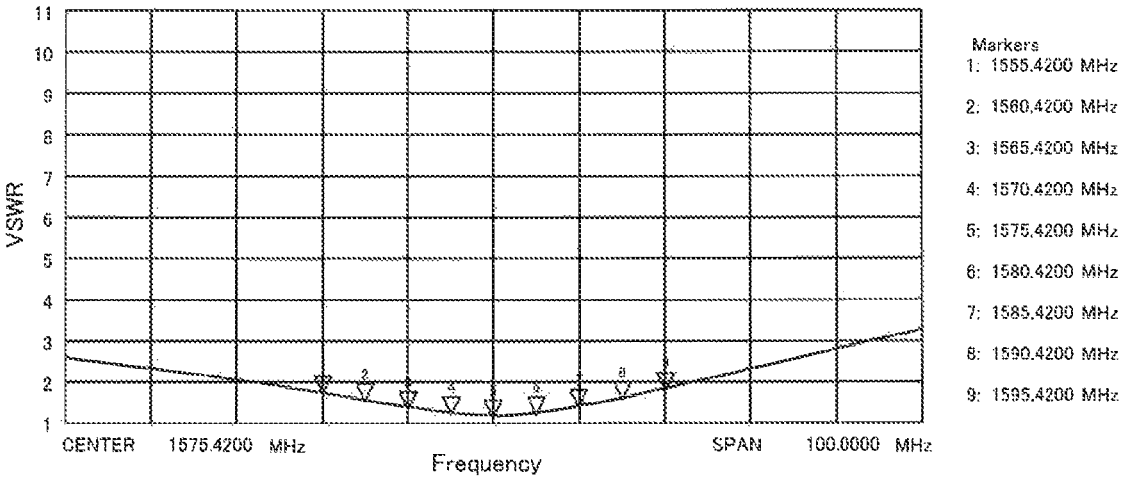
FIG. 22 It is a chart indicating the frequency characteristics of the VSWR of a conventional antenna.
Figure 23:
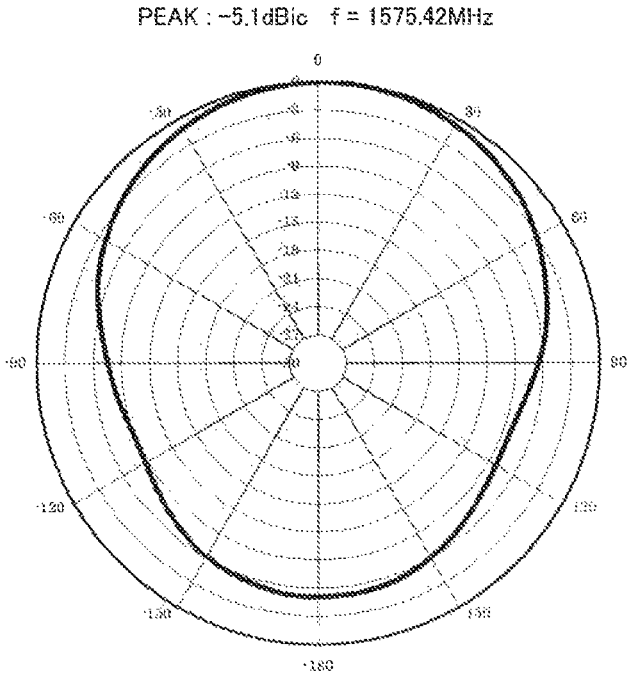
PRIOR ART FIG.23
FIG. 23 It is a chart indicating the radiation characteristics of a conventional antenna.

Referring to FIG. 11, the best VSWR value of about 1.1974 is shown at 1575.4200 MHz, and the VSWR value to be less than or equal to about 1.91 is shown in the range from 1555.4200 MHz to 1595.4200 MHz. The ring antenna 1 of the first embodiment has an approximately equal value compared with the frequency characteristics of the VSWR of the conventional antenna part 100 shown in FIG. 22, even when it is located in the metal exterior casing having the panel 12 and the work part 13 in the center. In this way, the ring antenna 1 of the first embodiment has good frequency characteristics of the VSWR, even when it is located near a conductor.

Also, FIG. 12 shows the radiation characteristics at 1575.4200 MHz of the center in the frequency band for the GPS, referring to FIG. 12, the radiation is the strongest in the zenith direction (0 degree), the peak value is approximately −2.5 dBic, which has the gain improved by approximately 2.6 dB from the gain which the single piece of the conventional antenna part 100 has. It shows that this radiation gain decreases as the elevation angle becomes small, and in the 90 degrees direction approximately −5 dB of the gain decreases from in the zenith direction, and in the −90 degrees direction approximately −6 dB of the gain decreases from in the zenith direction. Also, the average of the radiation gain is improved by approximately 2.5 dB compared with the radiation characteristic of the conventional antenna part 100, and the better radiation characteristic is shown. In this way, the ring antenna 1 of the first embodiment has good radiation characteristics, even when it is located near a conductor.

Moreover, in the case that either the ring antenna 2 or 3 of the second embodiment or the third embodiment as a substitute for the ring antenna 1 of the first embodiment is put in the GPS apparatus 50 shown in FIG. 1, 2, it exhibits approximately similar electric properties to the electric properties shown in FIG. 11, 12 as described above.

Also, located in the exterior casing 11, the ring antenna of this invention has some different aspects with regard to the height of the assembled ring antenna to the exterior casing 11, and a part consisting of the panel 12 and the work part 13, because the size of the exterior casing 11, the cover part 13 and others is slightly varied according to specifications. Therefore, the range which does not adversely affect the electric properties of the ring antenna is shown in FIG. 13-FIG. 16 by every aspect about the level of the assembled ring antenna. Further, although the ring antenna 1 of the first embodiment is shown as a typical example in FIG. 13-FIG. 16, not only the first embodiment, the ring antenna 2, 3 of the second or third embodiment is similarly applicable.

Figure 13:
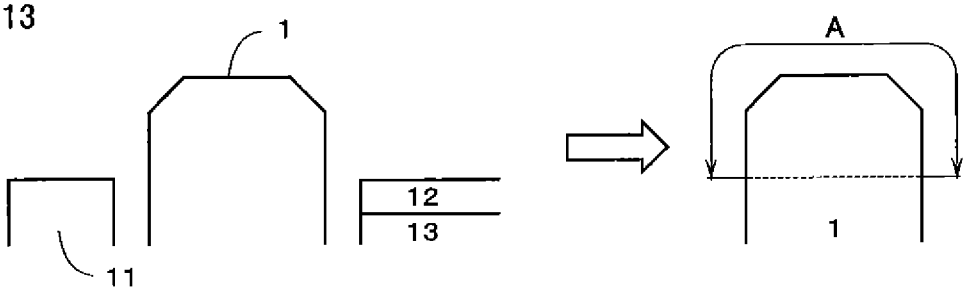
FIG. 13 It is an illustration indicating the area to place the C-shaped loop element on the ring antenna of the embodiment of this invention in the first mode.

FIG. 13 shows the first aspect that the level of the assembled ring antenna 1 is higher than the exterior casing 11 and a part consisting of the panel 12 and the work part 13 with the ring antenna 1 located in the GPS apparatus 50. In this case, it is suitable to form the C-shaped loop element 22*a* within the range A which is in the upper surface, the internal circumferential face and the outer circumferential face of the main body part 1*a* of the ring antenna 1, and above the upper surface of the exterior casing 11 and the upper surface of a part consisting of the panel 12 and the work part 13. In regard to the ring antenna 1 of the first embodiment to the ring antenna 3 of the third embodiment as described above, since the C-shaped loop element 22*a*-22*c* is located in the range A in each embodiment, each of the ring antenna 1-3 of the first embodiment to the third embodiment is applicable to the first aspect.

Figure 14:
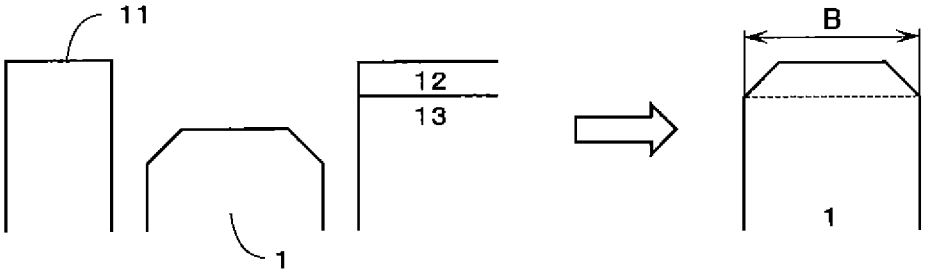
FIG. 14 It is an illustration indicating the area to place the C-shaped loop element on the ring antenna of the embodiment of this invention in the second mode.

Furthermore, FIG. 14 shows the second aspect that the level of the assembled ring antenna 1 is lower than the exterior casing 11 and a part consisting of the panel 12 and the work part 13 with the ring antenna 1 located in the GPS apparatus 50. In this case, it is suitable to form the C-shaped loop element 22*a* within the range B corresponding to the upper surface of the main body part 1*a* of the ring antenna 1. In regard to the ring antenna 1 of the first embodiment and the ring antenna 2 of the second embodiment as described above, the C-shaped loop element 22*a*, 22*b* is located in the range B, so both the ring antenna 1 and 2 of the first and second embodiment are applicable to the second aspect.

Figure 15:
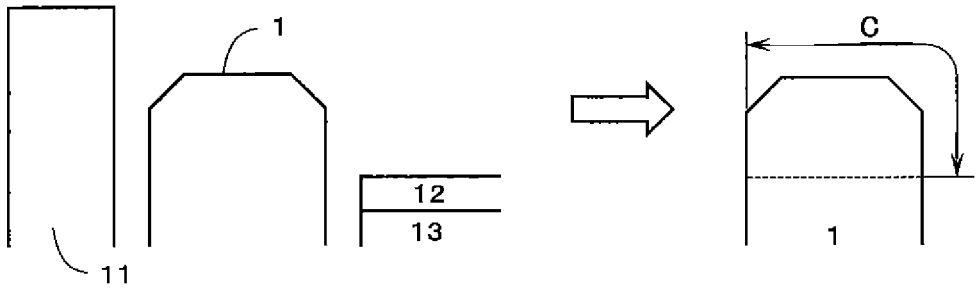
FIG. 15 It is an illustration indicating the area to place the C-shaped loop element on the ring antenna of the embodiment of this invention in the third mode.

Further, FIG. 15 shows the third aspect that the level of the assembled ring antenna 1 is lower than the exterior casing 11, and higher than a part consisting of the panel 12 and the work part 13 with the ring antenna 1 located in the GPS apparatus 50. In this case, it is suitable to form the C-shaped loop element 22*a* within the range C which is in the upper surface to the internal circumferential face of the main body part 1*a* of the ring antenna 1, and above the upper surface of a part consisting of the panel 12 and the work part 13. In regard to the ring antenna 1 of the first embodiment to the ring antenna 3 of the third embodiment as described above, the C-shaped loop element 22*a*, 22*b*, 22*c* is located in the range C, so each of the ring antenna 1-3 of the first embodiment to the third embodiment is applicable to the third aspect.

Figure 16:
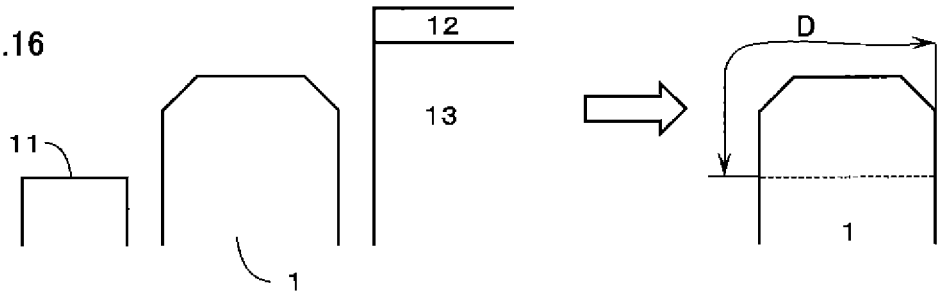
FIG. 16 It is an illustration indicating the area to place the C-shaped loop element on the ring antenna of the embodiment of this invention in the fourth mode.

Furthermore, FIG. 16 shows the fourth aspect that the level of the assembled ring antenna 1 is higher than the exterior casing 11, and lower than a part consisting of the panel 12 and the work part 13 with the ring antenna 1 located in the GPS apparatus 50. In this case, it is suitable to form the C-shaped loop element 22*a* within the range D which is in the upper surface to the outer circumferential face of the main body part 1*a* of the ring antenna 1, and above the upper surface of the exterior casing 11. In regard to the ring antenna 1 of the first embodiment and the ring antenna 2 of the second embodiment as described above, the C-shaped loop element 22*a*, 22*b* is located in the range D, so each of the ring antenna 1, 2 of the first and second embodiment is applicable to the fourth aspect.

Also, although the ring antenna 1 shown in FIG. 13-FIG. 16 is chamfered, it need not be chamfered, and may be chamfered as necessary.

Figure 17A:
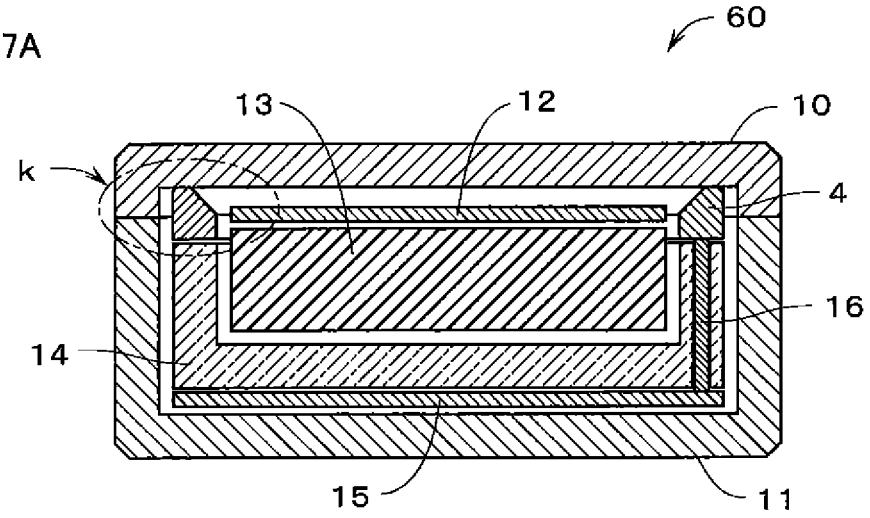
FIG. 17 It is a cross-sectional side view showing the configuration of the GPS apparatus, which applies the ring antenna of the fourth embodiment in this invention, and the enlarged view which expands one part.
Figure 17B:
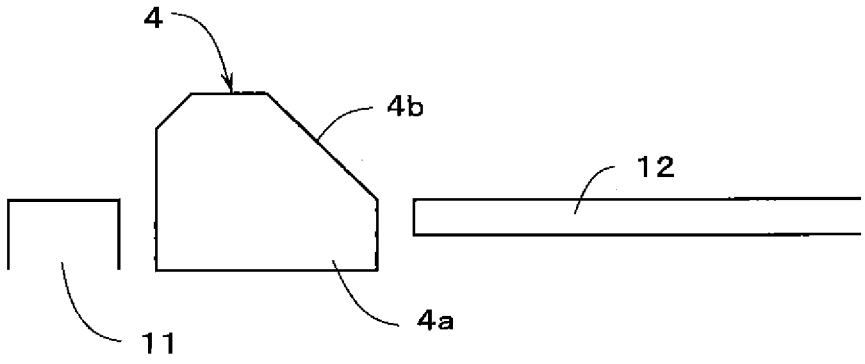

Then, a cross-sectional side view indicating the configuration of the GPS apparatus 60, which applies the ring antenna of the fourth embodiment of this invention, is shown in FIG. 17A, and the enlarged view which expands the k section is shown in FIG. 17B.

As shown in these figures, the ring antenna 4 of fourth embodiment, which is formed in a ring shape, is arranged on the upper surface of the side wall section of the antenna stand 14, and the tip of the feed conductor 16 is connected electrically to the feed part, which is formed on a lower face the ring antenna 4. An outside diameter of the ring antenna 4 is slightly smaller than an inside diameter of the exterior casing 11, and an inside diameter is slightly larger than an outside diameter of the work part 13 and the panel 12. The ring antenna 4 has a main body part 4*a* consisting of a ring shaped dielectric substance, and a cross-sectional shape of this main body part 4*a* is an substantially square, and a taper part 4*b* is formed extending over a halfway of the upper surface from a halfway of the inner face, and also the detailed configuration of the ring antenna 1 is mentioned later. Furthermore, a corner between the upper face and the outer face is chamfered. The taper part 4*b* is located at a level slightly above the panel 12, the tip of the exterior casing 11 is located at a level slightly below the middle of the main body part 4*a*. In this case, it is suitable to form the radiation element on a slope face of the taper part 4*b*, and to form the loop shaped C-shaped loop element on the upper surface of the main body part 4*a* facing the radiation element. The radiation element and the C-shaped loop element are arranged concentrically and connected electromagnetically, and the feed conductor 16 feeds to the radiation element. In this way, the C-shaped loop element being a passive element is excited by the radiation element. The ring antenna 4 is enabled to transmit and receive the circular polarized wave, and the signal received is led to the GPS receiving part incorporated in the circuit board 15 through the feed conductor 16. The other configuration of the GPS apparatus 60 is similar to the GPS apparatus 50 shown in FIG. 50, so the explanation for that configurations is omitted.

Also, providing the taper part 4*b* to the ring antenna 4, which is shown in FIG. 17, makes a dial plate or a display of time or information in the panel 12 easy to see.

Figure 18A:
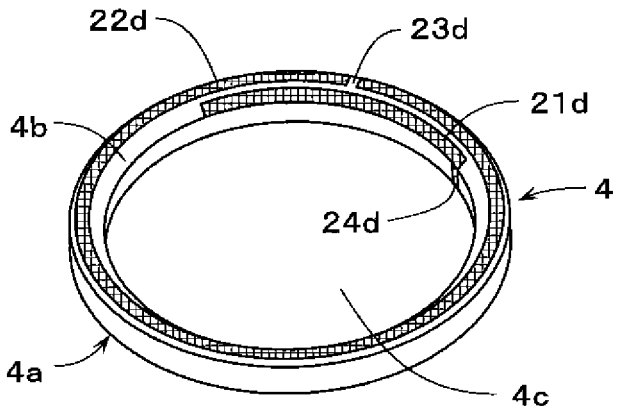
FIG. 18 It is a perspective view, a front view, and a top view showing the configuration of the fourth embodiment in the ring antenna of this invention.
Figure 18B:
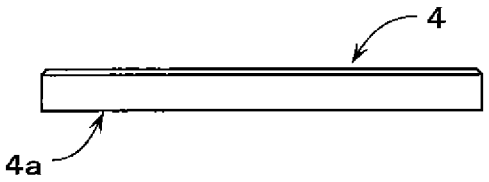
Figure 18C:
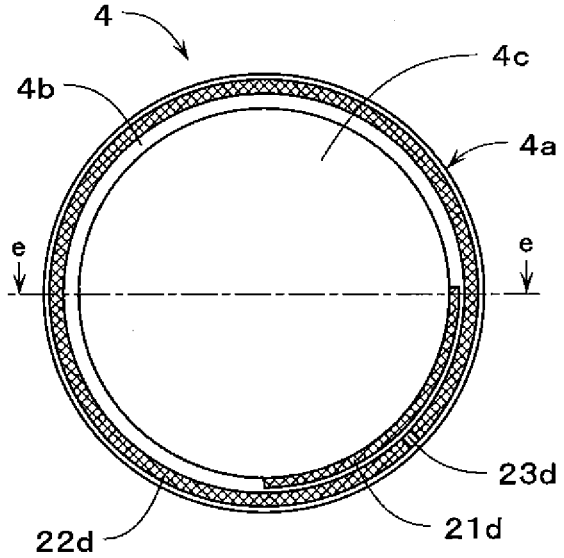
Figure 19A:
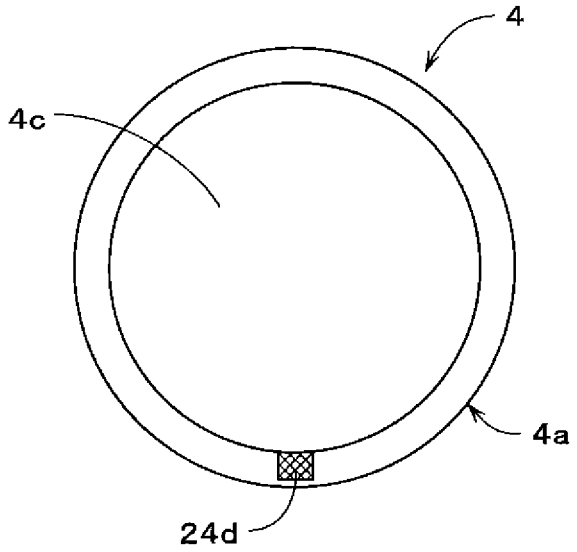
FIG. 19 It is a bottom view showing the configuration of the fourth embodiment in the ring antenna of this invention, the cross-sectional view along the line e-e.
Figure 19B:
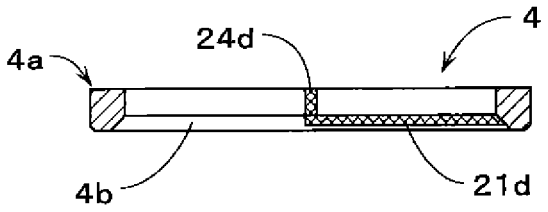
Figure 20:
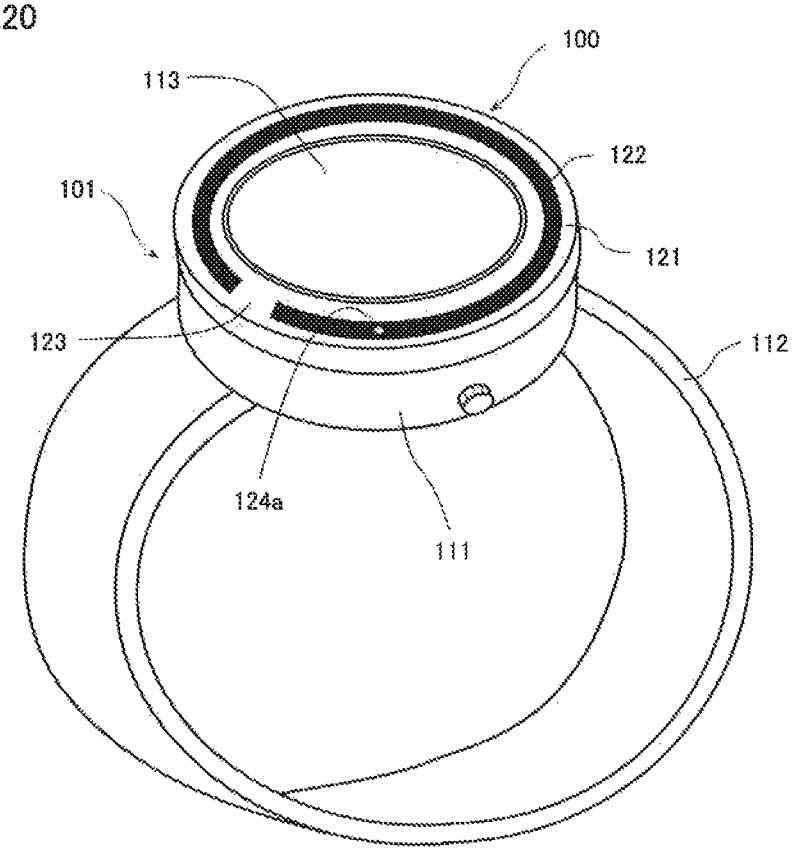
FIG. 20 It is a perspective view showing the configuration of the watch which incorporates a conventional GPS receiving terminal.
Figure 21:
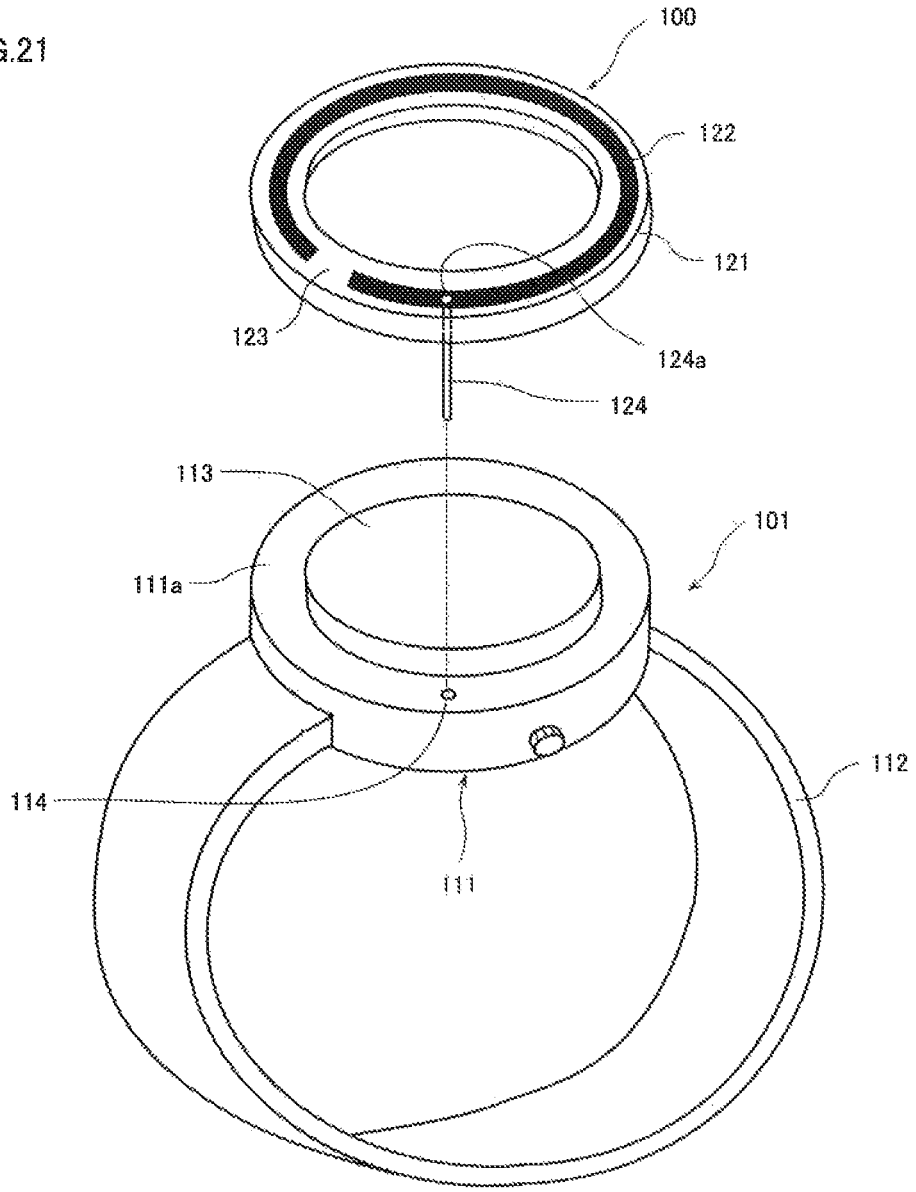
FIG. 21 It is an exploded perspective view showing the configuration of the watch which incorporates a conventional GPS receiving terminal.

Then, a perspective view indicating the configuration of the ring antenna 4 of the fourth embodiment is shown in FIG. 18A, a front view is shown in FIG. 18B, a top view is shown in FIG. 18C, a bottom view is shown in FIG. 19A, and a cross-sectional view along the line e-e is shown in FIG. 19B.

The ring antenna 4 of the fourth embodiment of this invention shown in these figures has a main body part 4*a* consisting of a ring-shaped dielectric substance where a large through-hole 4*c* is formed. A taper part 4*b* is formed extending over a halfway of the inner face from a halfway of the upper surface of the main body part 4*a*, a corner between the upper face and the outer face is chamfered. The C-shaped loop element 22*d* having a loop shape is formed on the upper surface of the main part body 4*a*, a cut part 23*d* having a prescribed length is arranged at a predetermined part of the C-shaped loop element 22*d*. Also, the arc shaped radiation element 21*d* having a prescribed length is formed at the taper part 4*b* of the main body part 4*a* so as to face the cut part 23*d* of the C-shaped loop element 22*d*. Additionally, an end of the radiation element 21*d* is bent downward to form a feed part 24*d*, and a pattern of this feed part 24*d* extends to a lower surface of the main body part 4*a*. The feed part 24*d*, which is arranged at the lower surface of the main body part 4*a*, is formed into a square shaped pattern having a predetermined area to contact electrically with the tip of the feed conductor 16. In the fourth embodiment of the ring antenna 4, because the radiation element 21*d* is arranged so as to face the C-shaped loop element 22*d* with a definite interval, both are connected electromagnetically. Also, the C-shaped loop element 22*d*, the radiation element 21*d* and the feed part 24*d* are formed on the main body part 4*a* consisting of the dielectric substance by depositing metal material or putting a metal thin plate.

The size of the ring antenna 4 of the fourth embodiment as described above is similar to the size of the ring antenna 1 of the first embodiment to the ring antenna 3 of the third embodiment, so the explanation for that configuration s is omitted. Also, when the angle θ between the feed part 24*d* (one end of the radiation element 21*d*) and the cut part 23*d* of the C-shaped element 22*d* is approximately +45 degrees or +225 degrees, a right-hand circular polarized wave is radiated from the antenna 4, when the angle θ is approximately −45 degrees or −225 degrees, a left-hand circular polarized wave is radiated from the antenna 4. In this instance, as for the angle θ, the optimum value is ±45 or ±225 degrees, the range of the angle for the right-hand circular polarized wave is approximately +0-+90 degrees or approximately +180-+270 degrees, the range of the angle for the left-hand circular polarized wave is approximately −0-−90 degrees or approximately −180-−270 degrees. Furthermore, when the ring antenna 4 of the fourth embodiment of this invention is built-in the GPS apparatus 60, the bottom surface of the exterior casing 11 works as a ground plane. Then, when the ring antenna 4 of the fourth embodiment is built-in the GPS apparatus 60, it exhibits approximately similar electric properties to the electric properties of the ring antenna 1 of the first embodiment, which is shown in FIG. 11, 12 as described above.

In regard to the ring antenna 4 of the fourth embodiment, the C-loop shaped element 22*d* may be arranged at the taper part 4*b*, and the radiation element 21*d* may be arranged on the outer circumference surface or the upper surface of the main body part 4*a*.

INDUSTRIAL APPLICABILITY

The ring antenna of every embodiment of this invention as mentioned above is able to put in a watch having the exterior casing as the watch body. Also, in case that the GPS receiving part is incorporated in the circuit board 15, when clock information is displayed on a panel, a year, a month, a day of the week, a hour, a minute, a second, and so on are displayed, and when received information is displayed on a panel by operating the button, which is not shown, for switching the display, a latitude, a longitude, a velocity, map information, and so on, which are calculated from the GPS signal of a circular polarize wave received by the ring antenna of this invention, are displayed. Accordingly, the watch having the ring antenna of this invention built-in is able to work as the receiver for the navigation system.

Also, although the exterior casing works as the ground plane of the ring antenna of this invention because of being generally made from metal, in the case that the exterior casing is non-conductive, a ground conductor is formed at the underside of the circuit board so as to work as the ground plane.

DESCRIPTION OF THE REFERENCE SYMBOLS

1,1' . . . Ring antenna, 1*a* . . . Main body part, 1*b* . . . Through-hole, 2 . . . Ring antenna, 2*a* . . . Main body part, 2*b* . . . Through-hole, 3 . . . Ring antenna, 3*a* . . . Main body part, 3*b* . . . Through-hole, 4 . . . Ring antenna, 4*a* . . . Main body part, 4*b* . . . Taper part, 4*c* . . . Through-hole, 10 . . . Cover part, 11 . . . Exterior casing, 12 . . . Panel, 13 . . . Work part, 14 . . . Antenna stand, 14*a* . . . insertion hole, 15 . . . Circuit board, 16,16' . . . Feed conductor, 17 . . . Source, 21,21' . . . Radiation element, 21*a* . . . Radiation element, 21*b* . . . Radiation element, 21*c* . . . Radiation element, 21*d* . . . Radiation element, 22 . . . C-shaped loop element, 22*a* . . . C-shaped loop element, 22*b* . . . C-shaped loop element, 22*c* . . . C-shaped loop element, 22*d* . . . C-shaped loop element, 23*a* . . . Cut part, 23*b* . . . Cut part, 23*c* . . . Cut part, 23*d* . . . Cut part, 24*a* . . . Feed part, 24*b* . . . Feed part, 24*c* . . . Feed part, 24*d* . . . Feed part, 50 . . . GPS apparatus, 60 . . . GPS apparatus, 100 . . . Antenna part, 101 . . . Main body of watch, 111 . . . Main body base, 111*a* . . . Ring-like step part, 112 . . . Band, 113 . . . Display part, 114 . . . Hole, 121 . . . Dielectric substrate, 122 . . . C-shaped loop element, 123 . . . Cut part, 124 . . . Feed pin, 124*a* . . . Feed point

The invention claimed is:

1. A ring antenna comprising:

a main body part consisting of a ring-shaped dielectric substance and being substantially square in cross-section;

a C-shaped loop element formed into a loop shape on an upper surface of the main body part and having a cut part in a part of the loop shape;

an arc-shaped radiation element that excites the C-shaped loop element and that is formed on an inner circumference surface of the main body part so as to be arranged approximately concentrically to the C-shaped loop element with a definite interval; and a feed conductor that feeds to the radiation element and that is formed on a lower surface of the main body part and whose tip is connected electrically to a feed part connected to one end of the radiation element, wherein the ring antenna is able to be put in a casing consisting of conductivity materials at least in a part, and the radiation element faces the cut part, and an angle θ between a first line from one end of the radiation element connected to a tip of the feed conductor to a center point of the C-shaped loop element and a second line from the cut part to the center point of the C-shaped loop element is approximately +45 degrees, approximately +225 degrees, approximately −45 degrees, or approximately −225 degrees.

2. The ring antenna according to claim 1, wherein if a free-space wavelength of the frequency band for use is defined as λ, an interval between the C-shaped loop element and the radiation element is approximately 0.001λ-0.05λ.

3. A ring antenna comprising:

a main body part consisting of a ring-shaped dielectric substance and being substantially square in cross-section;

a C-shaped loop element formed into a loop shape on an inner circumference surface of the main body part and having a cut part in a part of the loop shape;

an arc-shaped radiation element that excites the C-shaped loop element and that is formed on an outer circumference surface of the main body part so as to be arranged approximately concentrically to the C-shaped loop element with a definite interval; and a feed conductor that feeds to the radiation element and that is formed on a lower surface of the main body part and whose tip is connected electrically to a feed part connected to one end of the radiation element, wherein the ring antenna is able to be put in a casing consisting of conductivity materials at least in a part, and the radiation element faces the cut part, and an angle θ between a first line from one end of the radiation element connected to a tip of the feed conductor to a center point of the C-shaped loop element and a second line from the cut part to the center point of the C-shaped loop element is approximately +45 degrees, approximately +225 degrees, approximately −45 degrees, or approximately −225 degrees.

4. The ring antenna according to claim 3, wherein if a free-space wavelength of the frequency band for use is defined as λ, an interval between the C-shaped loop element and the radiation element is approximately 0.001λ-0.05λ.

5. A ring antenna comprising:

a main body part consisting of a ring-shaped dielectric substance and being substantially square in cross-section and having a taper part that extends from an upper surface to an inner face;

a C-shaped loop element formed into a loop shape on the upper surface of the main body part and having a cut part in a part of the loop shape;

an arc-shaped radiation element that excites the C-shaped loop element and that is formed on a slope face of the taper part of the main body part so as to be arranged approximately concentrically to the C-shaped loop element with a definite interval; and a feed conductor that feeds to the radiation element and that is formed on a lower surface of the main body part and whose tip is connected electrically to a feed part connected to one end of the radiation element, wherein the ring antenna is able to be put in a casing consisting of conductivity materials at least in a part, and the radiation element faces the cut part, and an angle θ between a first line from one end of the radiation element connected to a tip of the feed conductor to a center point of the C-shaped loop element and a second line from the cut part to the center point of the C-shaped loop element is approximately +45 degrees, approximately +225 degrees, approximately −45 degrees, or approximately −225 degrees.

6. The ring antenna according to claim 5, wherein if a free-space wavelength of the frequency band for use is defined as λ, an interval between the C-shaped loop element and the radiation element is approximately 0.001λ-0.05λ.

7. A ring antenna comprising:

a main body part consisting of a ring-shaped dielectric substance and being substantially square in cross-section;

a C-shaped loop element formed into a loop shape on an upper surface of the main body part and having a cut part in a part of the loop shape;

an arc-shaped radiation element that excites the C-shaped loop element and that is formed on the lower surface of the main body part so as to be arranged approximately concentrically to the C-shaped loop element with a definite interval; and a feed conductor that feeds to the radiation element and that is formed on a lower surface of the main body part and whose tip is connected electrically to a feed part connected to one end of the radiation element, wherein the ring antenna is able to be put in a casing consisting of conductivity materials at least in a part, and the radiation element faces the cut part, and an angle θ between a first line from one end of the radiation element connected to a tip of the feed conductor to a center point of the C-shaped loop element and a second line from the cut part to the center point of the C-shaped loop element is approximately +45 degrees, approximately +225 degrees, approximately −45 degrees, or approximately −225 degrees.

8. The ring antenna according to claim 7, wherein if a free-space wavelength of the frequency band for use is defined as λ, an interval between the C-shaped loop element and the radiation element is approximately 0.001λ-0.05λ.

* * * * *